United States Patent [19]

Senior et al.

[11] 4,174,560

[45] Nov. 20, 1979

[54] TOOL FOR APPLYING CONNECTORS TO FLEXIBLE CABLE

[75] Inventors: Robert B. Senior, Grand Haven; Paul A. Yarbrough, Muskegon, both of Mich.

[73] Assignee: Cooper Industries, Inc., Houston, Tex.

[21] Appl. No.: 887,906

[22] Filed: Mar. 17, 1978

[51] Int. Cl.[2] ..... H01R 43/04

[52] U.S. Cl. ..... 29/566.1; 7/107; 29/33 M; 29/268; 29/566.4; 29/750; 29/751; 81/363; 81/373

[58] Field of Search ..... 29/33 M, 566.1, 566.3, 29/566.4, 268, 749, 750, 751; 81/347, 352, 353, 354, 363, 373; 7/107

[56] References Cited

U.S. PATENT DOCUMENTS

| | | | |
|---|---|---|---|
| 2,992,576 | 7/1961 | Evans et al. | 81/363 X |
| 3,177,693 | 4/1965 | Batcheller | 7/107 X |
| 3,662,449 | 5/1972 | Hashimoto | 81/354 |
| 3,956,811 | 5/1976 | Munshower | 29/753 |
| 4,005,516 | 2/1977 | Bakermans | 29/749 |
| 4,070,754 | 1/1978 | Bauerkemper | 29/749 |

*Primary Examiner*—Z. R. Bilinsky
*Attorney, Agent, or Firm*—Michael E. Martin

[57] ABSTRACT

A portable manually operated tool for applying multi-contact connectors to flexible flat cable includes a pair of pivoted jaws which include respective connector body and cover holding members. The jaws are opened and closed by manually actuated handles including a locking toggle mechanism. The connector holding members include cooperating alignment guides and position stops. One of the connector holding members is mounted for limited movement on one of the jaws to provide for engagement of the alignment guides and to provide even distribution of the clamping force on the connector. The tool also includes a retractable cable cutter and positioning stop as well as a cable alignment and support tray.

16 Claims, 8 Drawing Figures

TOOL FOR APPLYING CONNECTORS TO FLEXIBLE CABLE

BACKGROUND OF THE INVENTION

Flexible electrical cables comprising a plurality of spaced apart side-by-side conductors contained in insulation material are now widely used in many types of electrical and electronic equipment. Connections to these cables are made by connector devices having insulation piercing terminals which are forcibly engaged with the cable to establish electrical contact with the respective conductors. The trend toward ever increasing numbers of conductors in flat flexible cables has demanded that tools for applying connectors to cable be developed which are capable of producing substantial and consistent clamping forces uniformly to the connector parts with each operation of the tool to be sure that suitable electrical contact is made between each conductor and its respective terminal. Moreover, the need to provide for field servicing and repair of electrical equipment using flat cable has also made it desirable to provide a portable easily manipulated, and manually actuated tool capable of generating the high forces necessary to apply the connector to the cables.

Furthermore, the close spacing of conductors in high density flat cables has made necessary the provision of a tool which is capable of accurate alignment of the connector parts with respect to each other and with respect to the cable to assure that each conductor is placed in suitable electrical contact with its intended terminal. The above mentioned desiderata as well as other features of a tool for applying connectors to multiconductor cables are provided for with the present invention.

Apparatus of the general type disclosed herein is disclosed in U.S. Pat. Nos. 3,956,811 and 4,005,516.

SUMMARY OF THE INVENTION

The present invention provides an improved tool for applying electrical connectors to flexible multiconductor flat cables wherein suitably high clamping forces may be easily produced with manual actuation, wherein the forces may be consistently repeated with each connector application, and wherein the clamping forces are uniformly applied to the connector to establish suitable electrical contact between each conductor and its respective terminal.

The present invention also provides for a manually actuated connector application tool wherein the operator may tangibly sense that the connector parts have been sufficiently clamped together with the cable to assure that full displacement of the insulation is obtained and that the conductors should be engaged with their respective terminals.

The present invention further provides a tool for applying connectors to flat cable conductors wherein improved alignment means are provided to assure that the connector parts are aligned with each other and with the cable. Cooperating guides are provided on opposed connector holding members which guides are engageable as pivotally connected jaws are closed to accurately align the connector holding members and maintain alignment while final clamping forces are applied. Positive stop means are also provided on the cooperating connector holding members to prevent damage to the connector and cable.

The connector applying tool of the present invention provides improved cable alignment means including a retractable member which locates the cable longitudinally with respect to the connector when cable end connections are to be made, and a cable support tray which maintains lateral alignment and support for the cable while the connector is being applied.

The connector applying tool of the present invention still further provides cable cutting means which may be actuated to make clean and precise transverse cuts in cables to provide cable ends, the cable cutting means being retractable when not used to prevent unwanted and accidental cutting of the cable.

The above mentioned superior features of the present invention as well as others disclosed herein will be recognized by those skilled in the art to which the invention pertains. Moreover, many features of the present invention may be employed in portable power operated tools and bench mounted tools as well as the hand-held manually actuated tool disclosed herein.

DESCRIPTION OF THE PREFERRED EMBODIMENT

Figure 8:
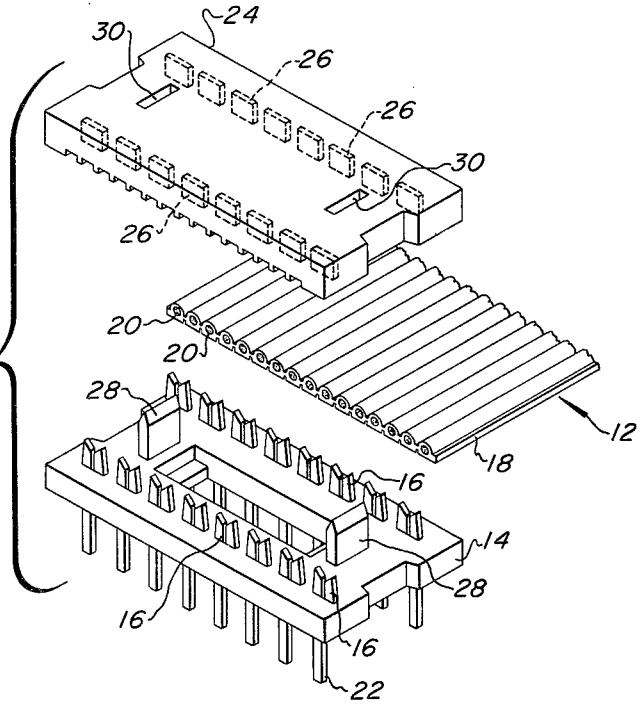

The tool of the present invention, which is shown in FIGS. 1 through 7 and generally designated by the numeral 10, is particularly adapted for applying a connector of the type shown in FIG. 8 to multiconductor flat cable 12, also shown in FIG. 8. Referring to FIG. 8, a multicontact connector is shown and characterized by a body 14 on which are mounted a plurality of closely spaced terminals 16. The terminals 16 are of the so-called insulation displacement type wherein each terminal has a pair of tines formed to pierce the insulation 18 of cable 12 and engage the respective conductor 20 to establish electrical contact therewith. In the particular connector shown in FIG. 8 the terminals are each formed to have an integral contact pin 22 projecting from the opposite side of the body 14. The connector shown in FIG. 8 also includes a cover member 24 having a plurality of openings 26 aligned with the respective terminals 16. Various connectors of the general type disclosed in FIG. 8 are now widely used in electrical equipment. The cable 10 is placed over the terminals 16 and pressed thereon with the cover member to displace the cable insulation and establish electrical contact between the terminals and the respective conductors 20. Projections 28 on the body 14 are adapted to engage cooperating openings 30 in the cover to assist in aligning the cover member with the body. Various clamping devices are also provided on some connectors to positively hold the cover and body together. The connector shown in FIG. 8 is merely exemplary of the general type of connector which may be applied with a tool according to the present invention.

Figure 1:
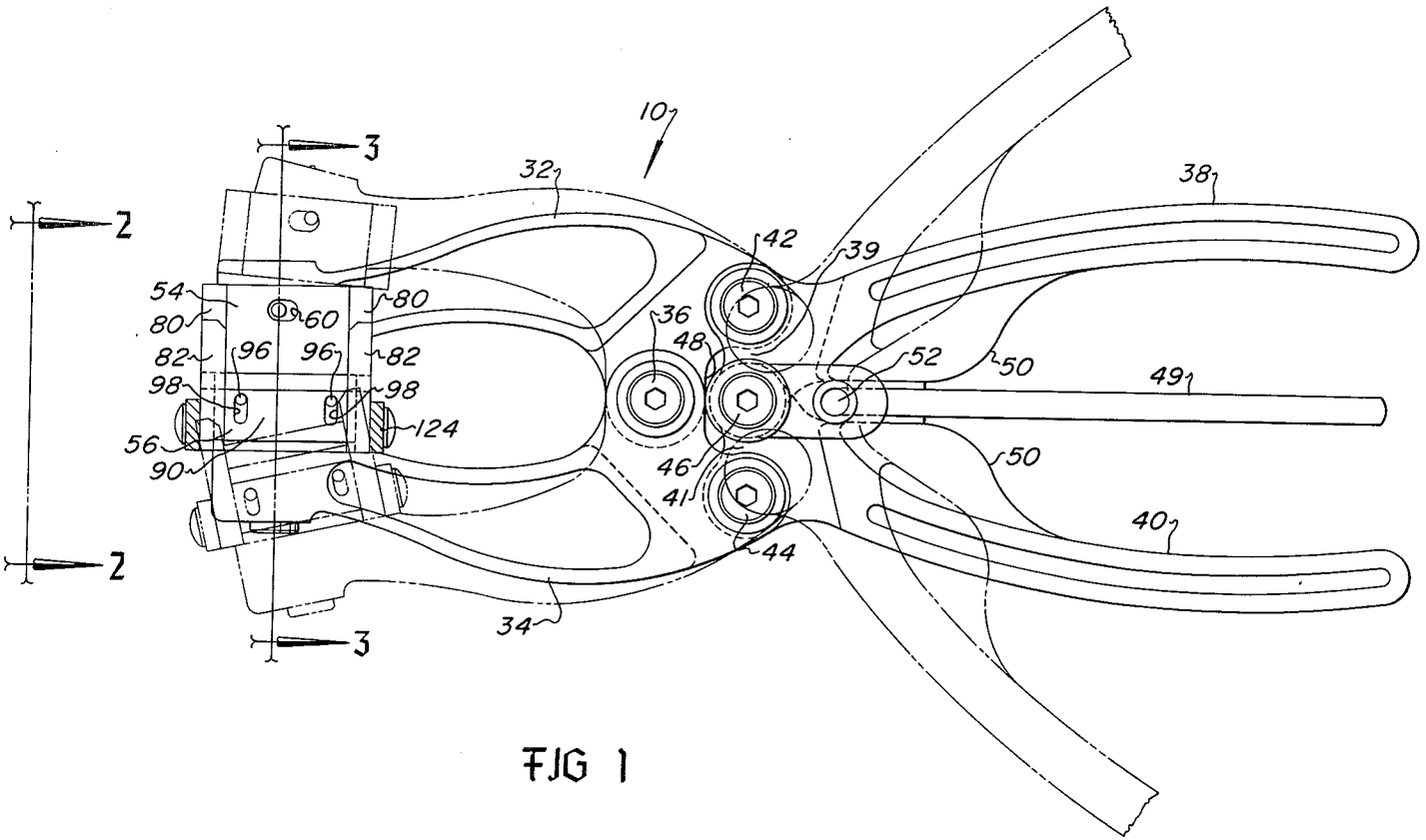
FIG. 1 is a longitudinal side elevation of a connector applying tool according to the present invention.

Referring to FIG. 1 the tool 10 is characterized by a pair of movable jaws 32 and 34 which are pivotally connected to each other by a pivot pin 36. The jaws 32 and 34 are also respectively pivotally connected to handles 38 and 40 at the respective pivots 42 and 44. The handles 38 and 40 are provided with integral links 39 and 41 which are pivotally connected to each other at 46. The jaw 32 is provided with an integral abutment 48 which engages the links in the completely closed position of the jaws to limit the movement of the handles 38 and 40 when the jaws are being closed to a position slightly past a centered position in line with the pivots 42 and 44. Accordingly, the jaws 32 and 34 and the handles 38 and 40 are constructed to provide a toggle mechanism which exerts a high closing force on the jaws with relatively slight effort to move the handles together. Moreover, in the completely closed position the toggle pivot 46 moves past the center line between the pivots 42 and 44 to lock the jaws in the closed position. The tool 10 also includes a toggle release trigger 49 disposed between cam surfaces 50 on the handles. The trigger 49 is mounted for pivotal movement at 52. Similar toggle release or jaw opening mechanisms are also described in some detail in U.S. Pat. Nos. 2,937,677 and 3,051,028.

Figure 4:
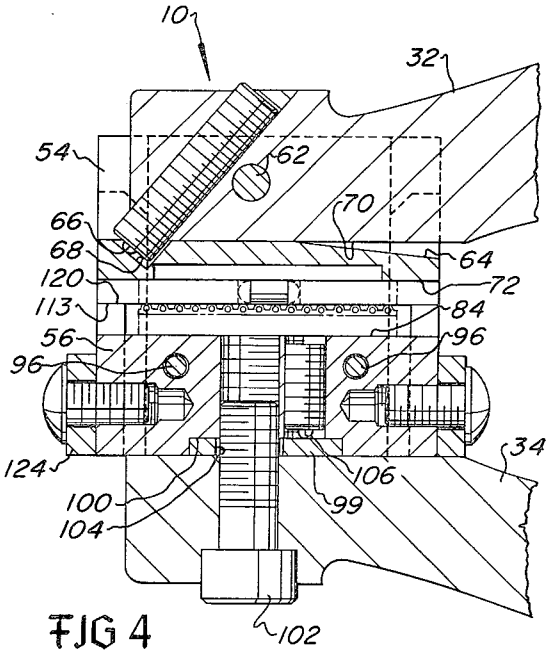
FIG. 4 is a fragmentary section view taken along the line 4—4 of FIG. 2.
Figure 2:
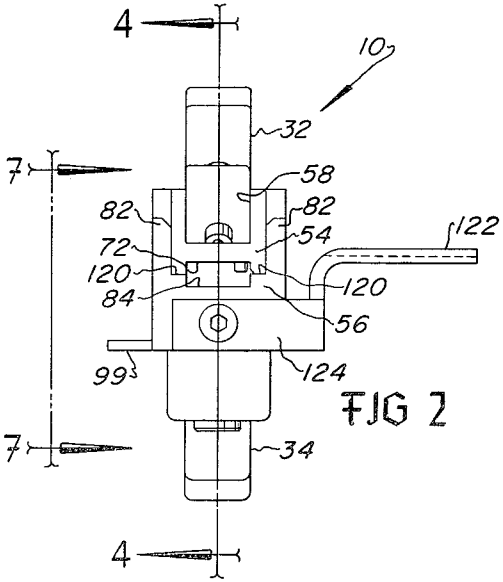
FIG. 2 is an end view of the tool shown in FIG. 1 taken from the line 2—2 of FIG. 1.

Referring to FIGS. 2 and 4 also, the tool 10 further includes a connector cover holding member 54 mounted on the distal end of the jaw 32 and a connector body holding member 56 mounted on the distal end of jaw 34. The member 54 is formed to have a longitudinal channel 58, FIG. 3, in which the jaw 32 is disposed. The holding member 54 includes opposed slots 60 which are elongated in the longitudinal direction of the channel 58 and are longer and wider than the diameter of a removable retaining pin 62 which is pressed through a suitable transverse bore in the jaw 32. The member 54 is thus loosely retained on the jaw 32 by the pin 62 and is allowed limited pivotal movement about the axis of the pin as well as limited omnidirectional movement with respect to the jaw in a plane perpendicular to the axis of the pin. The pin 62 may be replaced by a suitable threaded fastener whereby the member 54 could be more quickly interchanged with a similar holding member for use with a different cover configuration.

As may be noted in FIG. 4, the bottom of the channel 58 includes an inclined surface portion 64. The jaw 32 is also fitted with a spring biased plunger 66 which engages a notch 68 in the bottom of the channel 58. The plunger 66 yieldably biases the member 54 about the pivot axis formed by the pin 62 so that when the jaws are in the open position the channel surface portion 64 engages the bottom surface 70 of the jaw. In this way the member 54 is aligned to engage the guide posts to be described herein as the jaw moves in a curved path about the pivot 36 between open and closed positions.

Figure 5:
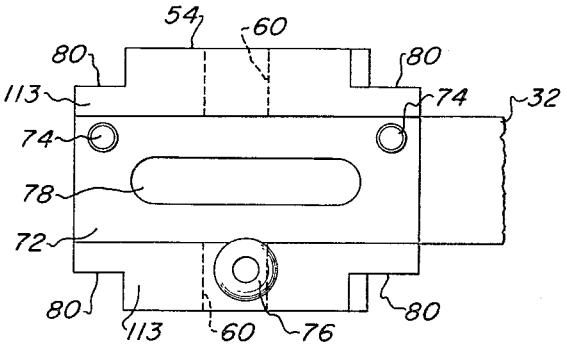
FIG. 5 is a plan view of the connector cover holding member.

As shown in FIG. 5 the cover holding member 54 is also provided with a recess 72 formed in the side of the member opposite the channel 58. A pair of pins 74 project from the bottom of the recess 72 and are positioned to align or locate the connector cover 24. A resilient member comprising a rubber o-ring 76 is suitably retained on the member 54 and projects slightly into the recess 72 for releasably retaining the cover member in the recess while the tool is operated to apply a connector to a cable. An elongated slot 78 in the bottom of the recess 72 provides clearance for the projections 28 on the connector body 14. As may be appreciated upon reading the foregoing the pins 74 may be replaced by, for example, forming the recess 72 as an enclosed rectangle having transverse end walls. Moreover, additional holes in the bottom of recess 72 might be provided for alternate locations of the pins 74 so that the member 54 could accommodate different sizes of connector covers.

The cover holding member 54 is further provided with four guideways 80 formed as L shaped recesses in each corner of the member extending in a direction generally perpendicular to the bottom of the recess 72. The guideways 80 are engageable with cooperating guide posts on the member 56 to be described in further detail herein.

Referring again to FIGS. 1 through 4, the connector body holding member 56 is characterized as a generally rectangular shaped block removably retained on the jaw 34 by a screw 102. The member 56 includes four integrally formed guideposts 82 projecting perpendicular to a longitudinal flat surface 84. The guideposts 82, as mentioned hereinabove, are engageable with the respective recesses 80 in the member 54 to maintain the members 54 and 56 in proper alignment with each other as the jaws 32 and 34 are closed to apply a connector to a cable. The distal ends of the guideposts 82 are provided with beveled surfaces 86 to assist in guiding the cover member 54 into alignment with the member 56 as the members are moved toward each other and the guideposts move into the guideways.

Figure 3:
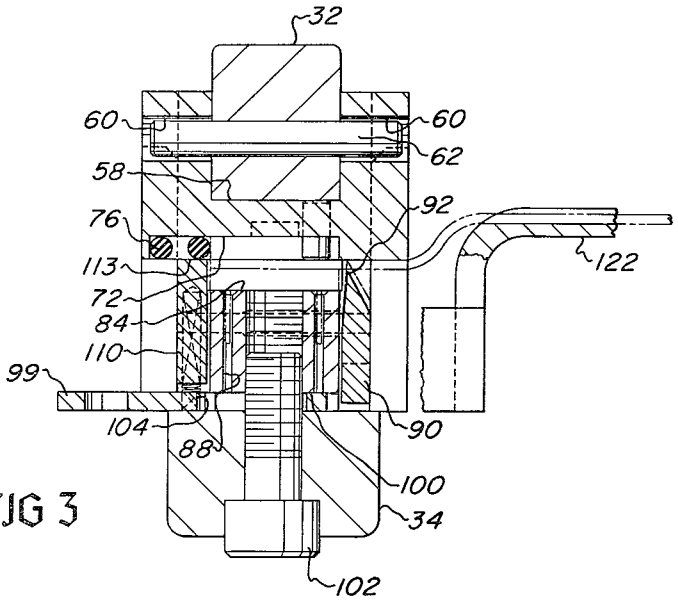
FIG. 3 is a section view taken along the line 3—3 of FIG. 1.
Figure 6:
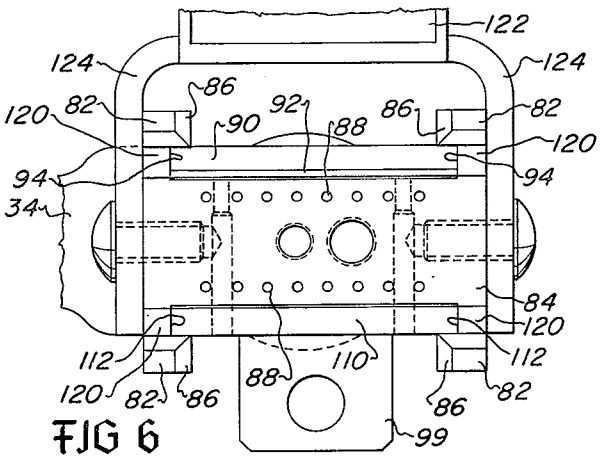
FIG. 6 is a plan view of the connector body holding member.
Figure 7:
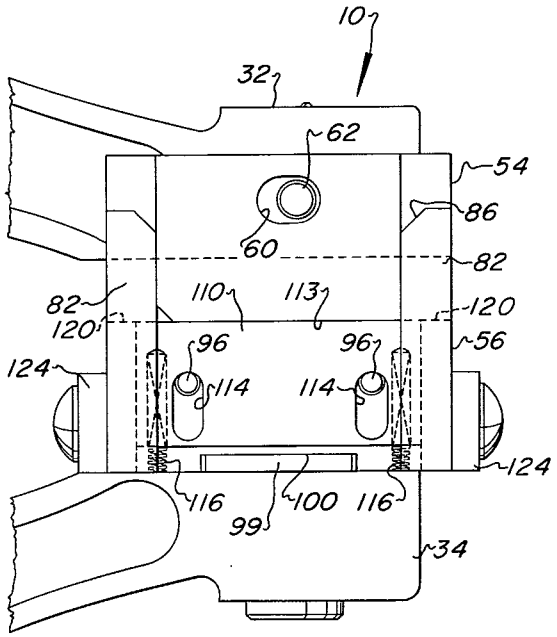
FIG. 7 is a fragmentary view of the tool showing the side opposite that shown in FIG. 1; and, FIG. 8 is a perspective view of a multicontact connector of a general type which a tool according to the present invention is adapted to apply to multiconductor flat cable.

Referring to FIGS. 3, 4, and 6 the surface 84, on which the connector body is placed preparatory to applying the connector to a cable, includes a plurality of holes 88 into which the terminal pins 22 of the connector body are inserted when the body is placed on the member 56. The holes 88 may be dimensioned and spaced from each other such that a slight interference fit with the pins 22 will be provided to retain the connector body on the member during the application process. For connectors without projecting contact pins the connector might be provided with two or more pins or projections whose function would be to hold the connector body on the member 56. Alternatively, the surface 84 may be formed in a slight depression in the member and resilient means such as the o-ring 76 may be used to releasably retain the body in the holding member in a manner similar to the way the cover 24 is retained in the holding member 54.

Referring to FIGS. 1, 3, and 6, in particular, the member 56 is provided with a cable cutoff blade 90 having a cutting edge 92 for making transverse severing cuts in the cable. The blade 90 is mounted in grooves 94 and is retained in assembly with the member 56 by pins 96 disposed in cooperating slots 98 in the blade. The blade 90 is movable between a cable cutting position, shown by the dashed lines in FIG. 3, and a retracted position shown by the solid lines in FIG. 3. The cable cutoff blade 90 is held in the cutting position by a movable plate 99. When the plate 99 is retracted as shown in FIG. 3, the blade 90 is free to retract clear of the cable. As shown in FIGS. 3 and 4 the plate 99 is slidable in a transverse channel 100 in the member 56 and is retained on the member by the screw 102 which is disposed in an elongated slot 104 in the plate. Referring to FIG. 4, a spring biased detent plunger 106 is disposed in the member 56 and is engaged with the plate 99 to hold the plate in either the retracted or blade engaging position.

The tool 10 is further provided with means for positioning the end of the cable prior to the clamping operation. Again referring to FIGS. 3 and 6 as well as FIG. 7, a retractable cable positioning stop plate 110 is slidably disposed in grooves 112 on the side of the member 56 opposite the cutoff blade 90. The plate 110 is retained on the member 56 by the removable pins 96 which project into elongated slots 114, FIG. 7. The cable stop plate 110 is yieldably biased by a pair of coil springs 116 into a position adjacent the connector body, when the body is disposed on the member 56, to serve as a stop or abutment against which the end of the cable may be positioned prior to closing the jaws. As the jaws are closed the plate 110 eventually engages a surface 113 and then retracts against the bias of the springs 116 to allow the members 54 and 56 to abut each other along stop surfaces 113 and 120, as shown in FIG. 2.

The tool 10 still further includes means for supporting the cable at a point relatively close to the jaws to facilitate handling the tool without having to continually hold the cable during the connector application process. Referring to FIGS. 2, 3, and 4 the cable support means is characterized by a shallow open ended tray 122 mounted on a supporting yoke 124 which is suitably secured to the member 56. The cable support tray 122 not only supports and aligns the cable adjacent to the holding member 56 but may also serve as a convenient handle for being gripped by one of the tool operator's hands while the other hand actuates the toggle release trigger 48.

If it is desired to use the tool 10 to cut a cable, the jaws 56 may be momentarily inverted to provide for the blade 90 to fall into the cable cutting position while the plate 99 is then pushed into position to hold the blade in the cutting position. Alternatively, the plate and blades base might be provided with cooperating cam surfaces to provide for pushing the blade into the cutting position by movement of the plate. The cable is then placed between the guideposts 82 and on the tray 122 to align it so that a substantially square cut is made and the jaws are then closed to cause the cutting edge 92 to force the cable against surface 113 and then sever the cable completely. Prior to using the tool 10 to apply a connector to the cable adjacent the end just cut the plate 99 is retracted to provide for the blade 90 to freely retract into a noncutting position as shown in FIG. 3.

The tool 10 is particularly adapted in accordance with the embodiment disclosed to apply connectors which have the body and cover completely separated from each other prior to the termination process. Accordingly, with the jaws 32 and 34 in the open position, a connector body and cover are respectively inserted in the holding members 34 and 32 as earlier described. If the connector is to be applied to the end of a cable, the cable is placed against the stop plate 110 and laid in the tray 122 over the top of the connector terminals. The tray 122 together with two of the guideposts 82 align the cable laterally. The stop plate 110 normally projects above the connector terminals so that the cable may be positioned against the plate. If the connector is to be applied intermediate the ends of the cable then all four guideposts 82 as well as the tray 122 serve to align the cable laterally.

With the connector parts mounted in their respective holding members and the cable in proper position the handles 38 and 40 may be actuated to pivot the jaws toward their closed positions. Before engaging the guideposts 82 the holding member 54 is biased by the plunger 66 into a pivotal position wherein the surface 64 is engaged with the surface 70 and the member is biased away from the distal end of the jaw so that the pin 62 is engaged with the end of the slots 60. As the jaws move toward each other the guideposts 82 engage the guideways 80 and the members 54 and 56 then move substantially linearly toward each other while the jaws continue to move in an arc about the pivot 36. Accordingly, the member 54 pivots about the pin 62 and moves longitudinally toward the jaw 32 as provided for by the pin and slot connection between the jaw and the cover holding member.

As the handles are actuated to close the jaws completely the toggle mechanism provides for substantial closing forces to assure that the connector body and cover are clamped together with the cable disposed therebetween and with the conductors brought into electrical contact with their respective terminals. The stop plate 110 easily retracts as the surface 113 on the member 54 comes into contact therewith. Thanks to the toggle mechanism of the tool 10 and the cooperating stop surfaces 113 and 120 the tool operator is able to feel a completed operation and is assured that the jaws are closed as far as they will go. When the jaw closing operation is completed the toggle release trigger 48 may be actuated to open the jaws whereby the connector and cable assembly may be removed from the tool.

The specific embodiment of the tool disclosed herein and in the accompanying drawings is particularly adapted to apply Scotchflex brand D.I.P. connectors made by the 3M Company, Minneapolis, Minn. However, without departing from the scope of the present invention, the members 54 and 56 may be easily interchanged with connector cover and body holding members which have been modified to apply many other specific types of flat cable connectors including those types wherein the connector body and cap or cover member are not completely separated from each other prior to the clamping operation.

What is claimed is:

1. A hand-held tool for applying a connector to flexible flat cable wherein said connector comprises a body having one or more terminals for making electrical contact with respective conductors in said cable, and a cover for holding said cable to said body, said tool comprising:

a pair of jaws being relatively movable one with respect to the other between open and closed positions;

a member disposed on one of said jaws for supporting said body;

a member disposed on the other of said jaws for engaging said cover to press said cover and said body together to establish terminations between said terminals and said conductors in response to moving said jaws to a closed position;

means for moving said jaws between open and closed positions;

a cable cutting blade; and, means for mounting said blade on one of said members for movement with respect to said one member between a position for cutting said cable and a non-cutting position.

2. The invention set forth in claim 1 together with:

means operable at will for retaining said blade in said cable cutting position.

3. A tool for applying a connector to flexible flat cable wherein said connector comprises a body having one or more terminals for making electrical contact with respective conductors in said cable, and a cover for holding said cable engaged with said body, said tool comprising:

a pair of jaws being relatively movable one with respect to the other between open and closed positions;

a member disposed on one jaw for supporting said body;

a member disposed on the other jaw for engaging said cover to press said cover and said body together to establish terminations between said terminals and said conductors in response to moving said jaws to a closed position;

a recess in said cover engaging member and resilient means projecting into said recess for engagement with said cover to releasably hold said cover in said recess prior to operating said tool to press said body and cover together;

at least one of said members being disposed for limited movement with respect to the jaw on which said one member is disposed; and, guide means for aligning one member with respect to the other member when said jaws are moved toward said closed position.

4. A tool for applying a connector to flexible flat cable wherein said connector comprises a body having one or more terminals for making electrical contact with respective conductors in said cable, and a cover for holding said cable engaged with said body, said tool comprising:

a pair of jaws pivotally connected to each other;

handle means connected to said jaws for pivotally moving said jaws between open and closed positions;

a member disposed on one jaw for supporting said body;

a member disposed on the other jaw for engaging said cover to press said cover and said body together to establish terminations between said terminals and said conductors in response to moving said jaws to a closed position;

means for retaining one of said members on the jaw on which said one member is disposed for limited movement of said one member with respect to said jaw to provide for aligning said one member with said other member when said jaws are moved toward said closed position; and, guide means comprising a plurality of spaced apart guideposts on one of said members and cooperating guideways on the other of said members, said guideposts and guideways being movable from a disengaged condition when said jaws are in an open position to an engaged condition when said jaws are moved toward said closed position to provide for guiding said members into alignment with each other.

5. The invention set forth in claim 4 wherein:

said member for supporting said body includes a mounting surface, a cable positioning stop for engagement with the end of said cable for aligning said cable with respect to a body mounted on said surface, and means for mounting said stop on said member for supporting said body for movement from a cable engaging position to a retracted position with respect to said member for supporting said body when said jaws are closed.

6. The invention set forth in claim 4 together with:

a cable cutting blade and means for mounting said blade on one of said members for movement with respect to said one member between a position for cutting said cable and a non-cutting position.

7. The invention set forth in claim 6 together with:

means operable at will for retaining said blade in said cable cutting position.

8. The invention set forth in claim 4 wherein:

said handle means comprises a pair of handles each of which is pivotally connected to one of said jaws and to the other handle at a common handle pivot to form a toggle mechanism which is moved to a jaw locked condition when said jaws are closed to press a connector body and cover together with a cable disposed therebetween.

9. The invention set forth in claim 4 wherein:

said members each include cooperable stop surfaces disposed to be engaged when said jaws are closed to limit the movement of one member toward the other member.

10. The invention set forth in claim 4 wherein:

said cover engaging member includes means for holding said cover on said cover engaging member prior to operating said tool to press said body and cover together.

11. The invention set forth in claim 4 together with:

means for yieldably biasing said one member to a limit position with respect to the jaw on which said one member is disposed for aligning said guideways with said guideposts when said jaws are pivoted toward the closed position.

12. The invention set forth in claim 4, together with:

a cable support tray on said tool for supporting said cable while said connector is being applied to said cable.

13. A hand-held tool for applying a connector to flexible flat cable wherein said connector comprises a body having one or more terminals for making electrical contact with respective conductors in said cable, and a cover for holding said cable to said body, said tool comprising:

a pair of jaws being relatively movable one with respect to the other between open and closed positions;

a member disposed on one of said jaws for supporting said body;

a member disposed on the other of said jaws for engaging said cover to press said cover and said body together to establish terminations between said terminals and said conductors in response to moving said jaws to a closed position;

means for moving said jaws between open and closed positions;

a cable positioning stop for engagement with the end of said cable for aligning said cable with respect to a body supported on said member; and, means for mounting said stop on said member for supporting said body for movement from a cable engaging position to a retracted position with respect to said member for supporting said body when said jaws are closed.

14. The invention set forth in claim 13 together with:

means for aligning said cable laterally with respect to the length of said cable so that said conductors are in proper lateral position with respect to said terminals for engagement therewith.

15. The invention set forth in claim 14 wherein: said means for aligning said cable laterally includes a cable support tray on said tool for supporting said cable while said connector is being applied to said cable.

16. The invention set forth in claim 14 wherein: said means for aligning said cable laterally includes a plurality of spaced apart guideposts on one of said members which guideposts are further operable to engage cooperating guideways on the other of said members to provide for aligning one member with respect to the other member when said jaws are moved toward said closed position.

* * * * *